United States Patent [19]

Bauer

[11] 4,232,475

[45] Nov. 11, 1980

[54] TETHERED TOP USABLE IN TWO WAYS

[76] Inventor: Harvey E. Bauer, 9124 Thilow Dr., Sacramento, Calif. 95826

[21] Appl. No.: 866,845

[22] Filed: Jan. 4, 1978

[51] Int. Cl.[3] ..... A63H 1/30; A63H 1/32

[52] U.S. Cl. ..... 46/61; 46/63

[58] Field of Search ..... 46/61, 62, 63

[56] References Cited

U.S. PATENT DOCUMENTS

| | | | |
|---|---|---|---|
| 676,125 | 6/1901 | Falardeau | 46/63 |
| 742,194 | 10/1903 | Johnson | 46/63 |
| 1,311,534 | 7/1919 | Seymour | 46/61 |
| 2,645,881 | 7/1953 | Frangos | 46/63 |
| 3,156,068 | 11/1964 | Nelligan | 46/61 |

*Primary Examiner*—F. Barry Shay

*Attorney, Agent, or Firm*—Blair, Brown & Kreten

[57] ABSTRACT

Disclosed herein is a whistle toy which is actuated by the oscillatory motion of the user in which two strings threaded on the toy member causes the toy to rotate in such a manner that oval shaped holes disposed on the outer periphery of the toy generate a whistling affect while the toy is being rotated. The toy comprises spaced halves connected by two shafts which together form an oblong connecting means. A string may be secured to the oblong connecting means to prepare the toy for use as a yo-yo. Handles are disposed at the extremities of the string so that the string can be easily grasped for providing the oscillatory motion necessary to make the whistling affect.

2 Claims, 5 Drawing Figures

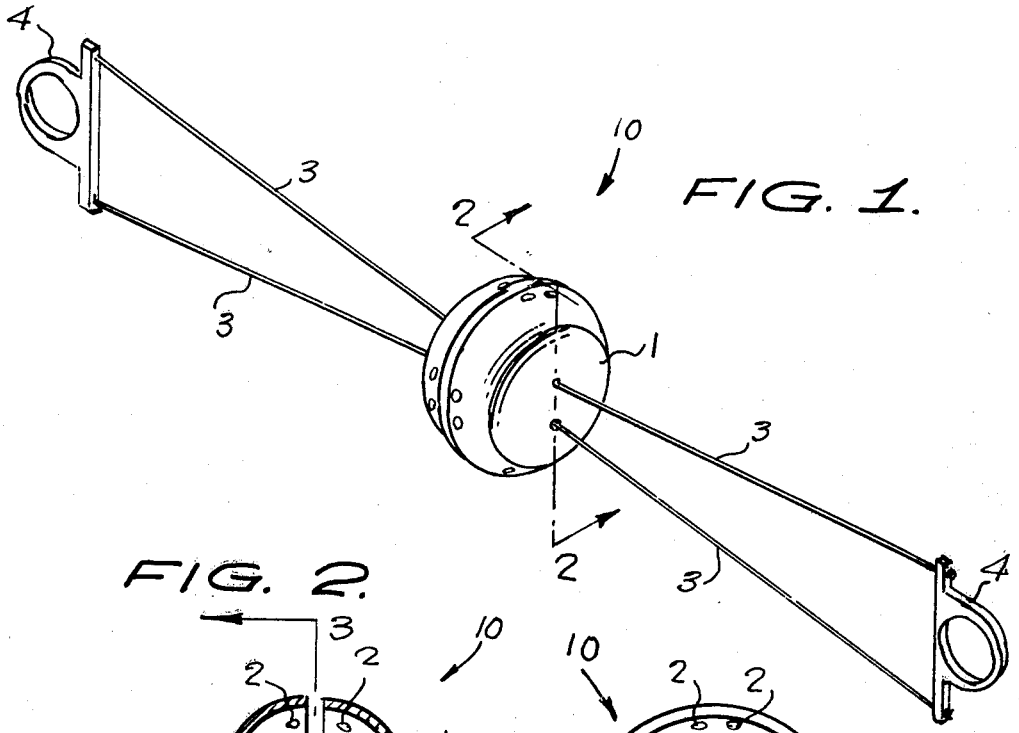
FIG. 1.
FIG. 2.
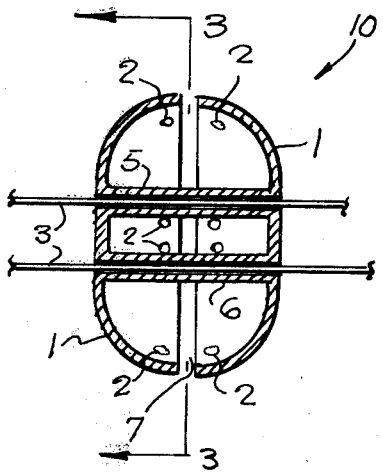
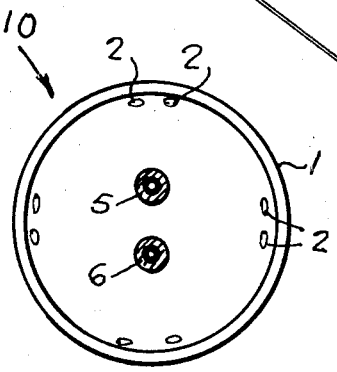
FIG. 3.
FIG. 4.
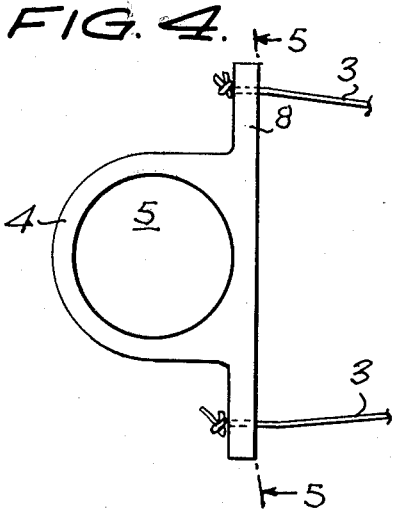
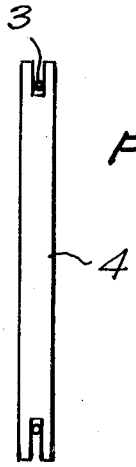
FIG. 5.

TETHERED TOP USABLE IN TWO WAYS

BACKGROUND OF THE INVENTION

FIELD OF THE INVENTION

Toys similar to the insuing description relating to whistle toys have been in existence for quite some time. Toys of which the applicant is aware includes U.S. Pat. Nos. 2,991,586, 3,004,365, 3,052,060, 3,501,860, 3,516,195, 3,737,162 and 3,789,545. Admittedly, several of these patents disclose a structure fairly similar to applicant's, but none of them are provided with the whistle producing orifices carefully disposed on the outer periphery of the toys which provide the unique whistling affect.

SUMMARY OF THE INVENTION

Accordingly, the following application constitutes an improvement over the state of the art by providing a whistling type toy of the sort described hereinabove which has noise producing orifices disposed on the outer periphery of the toy to provide a pleasant sound while the object is being rotated through oscillatory motion transmitted by the strings.

OBJECT OF THE INVENTION

Accordingly, it is an object of this invention to provide a toy which rotates and while doing so provides a pleasant whistling noise.

Another object of this invention is to provide a toy which is durable yet inexpensive.

These and other objects will be made manifest when considering the following detailed specification and ensuing claims when viewed with the drawings.

BRIEF DESCRIPTION OF THE DRAWINGS

FIG. 1 is a perspective view of the toy according to the present invention;

FIG. 2 is a sectional view taken along lines 2—2 of FIG. 1;

FIG. 3 is a sectional view taken along lines 3—3 of FIG. 2;

FIG. 4 is a detailed view of the hand grasp mechanism shown in FIG. 1; and FIG. 5 shows a sectional view taken along the lines 5—5 of FIG. 4.

DESCRIPTION OF THE PREFERRED EMBODIMENT

Referring to the drawings now wherein like reference numerals refer to like parts throughout the several drawings therein, reference numeral 10 generally denotes the whistle toy according to the present invention.

This toy may be regarded as having a central portion of generally oval configuration when viewed in the sectional depiction of FIG. 2 but further is provided with planar sides. It is important to note that a hollow recess denoted by numeral 7 of FIG. 2 is a recess which extends substantially throughout the entire oval body 1. Therefore the body 1 is generally regarded as being provided with two halves and they are interconnected by means of shaft members 6 which, when taken together, form connecting means oblong in transverse section (see FIG. 3). The halves are preferably formed of Teflon or another similar type plastic which provides the juncture between the two halves 1 of the body in accordance with the present invention. Disposed around the recess area 7 on each of the body halves 1 are a plurality of orifices 2 which are primarily responsible for the whistling affect this toy has when it is being rotated. The connecting links 6 are hollow and serve to provide a support and a minimal frictional carrier for the strings 3 which traverse therethrough.

The strings 3 are connected at their extremities to hand grips 4 which are best seen in FIG. 4 and these hand grips 4 can generally be regarded as being defined by a circular void 5 surrounded by a plastic material in which the circular void is bounded on one face tangentially with a cross bar which is used to constrain and retain the strings 3.

In addition it is to be noted that another form of this invention comprises providing the shaft connector 6 of the whistling toy with a string along the recess area 7 to provide a yo yo type affect that whistles.

In operation, the toy is wound about the string whereby twisting the two string elements since the two holes for the strings are offset from the geometrical center or axis of the toy. Thereafter an oscillatory motion provided by the user on the ring elements 4 will cause the toy to rotate and whistle.

Having thus described the invention it will be apparent that numerous structural modifications are intended as being a part of this invention as specified hereinabove and as defined hereinbelow by the appended claims.

What is claimed is:

1. A whistling toy comprising a central body element having a substantially oval configuration in cross section and planar vertical faces, a central recess area which defines two symmetrical body portions, edges of said vertical faces sloping towards said recess area due to said oval configuration, said two portions being connected by only two shafts which together form connecting means oblong in transverse section, each shaft disposed on a diametrical line offset from a center of rotation of said toy, and strings inserted within and shafts connected to handle means, and orifices disposed on the sloping edges to provide said whistle by air passing through said orifice whereby said strings are adapted to be removed from within said shafts, a string secured externally to at least one of said shafts and wrapped around said shafts in said central recess area to provide a yo-yo.

2. The device of claim 1 in which said handle means includes a ring having generally circular configuration connected tangentially to a bar having opposed extremities connected to the strings.

* * * * *